US005942465A

United States Patent [19]

Burns et al.

[11] Patent Number: 5,942,465

[45] Date of Patent: Aug. 24, 1999

[54] THERMAL DYE TRANSFER ASSEMBLAGE WITH LOW TG POLYMERIC RECEIVER MIXTURE

[75] Inventors: Elizabeth G. Burns; John DiCillo; Kristine B. Lawrence, all of Rochester, N.Y.

[73] Assignee: Eastman Kodak Company, Rochester, N.Y.

[21] Appl. No.: 09/035,709

[22] Filed: Mar. 5, 1998

[51] Int. Cl.[6] ..... B41M 5/035; B41M 5/38

[52] U.S. Cl. ..... 503/227; 428/195; 428/480; 428/913; 428/914

[58] Field of Search ..... 8/471; 428/195, 428/913, 914, 480; 503/227

[56] References Cited

U.S. PATENT DOCUMENTS

| | | | |
|---|---|---|---|
| 4,504,531 | 3/1985 | Murata et al. | 428/35 |
| 4,668,560 | 5/1987 | Kobayashi et al. | 428/195 |
| 5,534,479 | 7/1996 | Shuttleworth et al. | 503/227 |
| 5,627,128 | 5/1997 | Bowman et al. | 503/227 |

FOREIGN PATENT DOCUMENTS

| | | | |
|---|---|---|---|
| 5/238174 | 9/1993 | Japan | 503/227 |

*Primary Examiner*—Bruce H. Hess
*Attorney, Agent, or Firm*—Harold E. Cole

[57] ABSTRACT

A thermal dye transfer assemblage comprising:

(a) a dye-donor element comprising a support having thereon a dye layer comprising a dye dispersed in a polymeric binder, said dye being:

I) an electrically neutral, deprotonated, delocalized cationic dye precursor;

II) a pendant basic dye of the formula D-(L-E)$_m$ wherein D represents the residue of a dye, L represents a linking group, E represents a moiety with basic properties and m is an integer of 1–3; or III) a cationic dye precursor having the following structure:

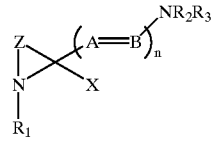

and (b) a dye-receiving element comprising a support having thereon a polymeric dye image-receiving layer, the dye-receiving element being in a superposed relationship with the dye-donor element so that the dye layer is in contact with the dye image-receiving layer, the dye image-receiving layer comprising a mixture of i) a polymer having a Tg of less than about 19° C. and having no or only slight acidity; and ii) a polyester which has been polymerized in the presence of an aluminum salt and which contains an aluminum ion.

14 Claims, No Drawings

THERMAL DYE TRANSFER ASSEMBLAGE WITH LOW TG POLYMERIC RECEIVER MIXTURE

CROSS REFERENCE TO RELATED APPLICATIONS

Reference is made to commonly-assigned U.S. Pat. No. 5,753,590 entitled "Thermal Dye Transfer Assemblage With Low Tg Polymeric Receiver Mixture" by Harrison et al.; U.S. Pat. No. 5,804,531 entitled "Thermal Dye Transfer System With Polyester Ionomer Receiver" by Evans et al.; and U.S. Pat. No. 5,789,344 entitled "Thermal Dye Transfer Assemblage With Low Tg Polymeric Receiver Mixture" by Kung et al.; the disclosures of which are incorporated herein by reference.

FIELD OF THE INVENTION

This invention relates to a thermal dye transfer receiver element of a thermal dye transfer assemblage and, more particularly, to a polymeric dye image-receiving layer containing a mixture of materials capable of reprotonating a deprotonated cationic dye, pendant basic dye or cationic dye precursor transferred to the receiver from a suitable donor.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dyes for thermal dye transfer imaging should have bright hue, good solubility in coating solvents, good transfer efficiency and good light stability. A dye receiver polymer should have good affinity for the dye and provide a stable (to heat and light) environment for the dye after transfer. In particular, the transferred dye image should be resistant to damage caused by handling, or contact with chemicals or other surfaces such as the back of other thermal prints, adhesive tape, and plastic folders such as poly(vinyl chloride), generally referred to as "retransfer".

Commonly-used dyes are nonionic in character because of the easy thermal transfer achievable with this type of compound. The dye-receiver layer usually comprises an organic polymer with polar groups to act as a mordant for the dyes transferred to it. A disadvantage of such a system is that since the dyes are designed to be mobile within the receiver polymer matrix, the prints generated can suffer from dye migration over time.

A number of attempts have been made to overcome the dye migration problem which usually involves creating some kind of bond between the transferred dye and the polymer of the dye image-receiving layer. One such approach involves the transfer of a cationic dye to an anionic dye-receiving layer, thereby forming an electrostatic bond between the two. However, this technique involves the transfer of a cationic species which, in general, is less efficient than the transfer of a nonionic species.

In one type of thermal dye transfer printing, deprotonated nonionic dyes may be transferred to an acid-containing receiver where a reprotonation process may take place to convert the dyes to their protonated form by interaction with the acid moiety in the dye-receiving layer. The dyes are thus rendered cationic. As a consequence, the transferred dyes are anchored in the receiving layer and form a strong electrostatic bond. The reprotonation reaction also causes a hue shift of the transferred dyes from their deprotonated form to their protonated form. In a practical sense, it is always desirable to complete this protonation (dye conversion) process as fast as possible.

DESCRIPTION OF RELATED ART

U.S. Pat. No. 4,668,560 describes the use of saturated polyesters in receiver layers that contain aluminum, magnesium, calcium and tin salts. However, metal salts are added after polymerization and are explicitly limited to organic acid salts. The polymer-salt mixtures are then cast into films from non-aqueous solvents and used as dye receiver layers for non-reactive dyes. There is a problem with this polymer-salt mixture in that it does not reprotonate a deprotonated cationic dye, pendant basic dye or cationic dye precursor transferred to the receiver from a suitable donor.

U.S. Pat. No. 4,504,531 describes the covalent incorporation of aluminum atoms into the backbone of polyesters by the synthesis of aluminum-carboxylate precursors. However, this patent does not describe the use of anhydrous aluminum salts, nor does it describe the use of such materials for imaging.

U.S. Pat. No. 5,534,479 relates to the transfer of a deprotonated cationic dye to a dye image-receiving layer containing an organic acid moiety as part of a polyester polymer which is capable of reprotonating the deprotonated cationic dye. There is no disclosure in this patent that describes the use of mixtures comprising a metal salt capable of reprotonating the deprotonated cationic dyes and a polyester polymer. In addition, there is a problem with the polymers used in this patent in that they contain strong acids which catalyze the hydrolysis of the polyester backbone which changes the properties of the polymer making it more hygroscopic and tacky.

U.S. Pat. No. 5,627,128 relates to the transfer of a deprotonated cationic dye to a polymeric dye image-receiving layer comprising a mixture of an organic polymeric or oligomeric acid which is capable of reprotonating the deprotonated cationic dye and a polymer having a Tg of less than about 19° C. and having no or only slight acidity, such as an acrylic, styrene or vinyl polymer which contains ester groups. There is a problem with this polymer mixture, however, in that such organic polymeric or oligomeric acids cause hydrolysis of such ester groups which causes physical properties of the receiver layer to change over time.

JP05-238174 describes the thermal transfer of pendant basic dyes of the formula A-(L-B)n to receiving elements containing acidic materials. A represents the residue of a dye, L represents a covalent linking group, B represents a basic substituent and n is an integer of 1–3. The preferred acidic materials are phenols and carboxylic acids. There is a problem with the acidic receiving elements described in that they do not effectively protonate and bind thermally transferred basic dyes, as will be shown below.

It is an object of this invention to provide a polyester material that has been polymerized in the presence of an aluminum salt. It is a further object of this invention that an aluminum ion contained in the polyester material will reprotonate a deprotonated cationic dye transferred to it at a rate faster than what can be achieved with receiver elements containing a sulfonic acid-derived polyester.

SUMMARY OF THE INVENTION

These and other objects are achieved in accordance with this invention which relates to a thermal dye transfer assemblage comprising:

(a) a dye-donor element comprising a support having thereon a dye layer comprising a dye dispersed in a polymeric binder, the dye being:

I) an electrically neutral, deprotonated, delocalized cationic dye precursor;

II) a pendant basic dye of the formula D-(L-E)$_m$ wherein D represents the residue of a dye, L represents a linking group, E represents a moiety with basic properties and m is an integer of 1–3; or III) a cationic dye precursor having the following structure:

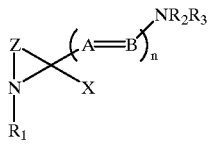

wherein:

$R_1$, $R_2$ and $R_3$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

A and B each independently represents N or CR and may be part of an aromatic or heteroaromatic ring system;

X represents —OR, —N(R)$_2$, —NRCOR, —NRSO$_2$R, —SR, —SO$_2$R, —S(O)R, —O$_2$CR, —NRCON(R)$_2$, —OCON(R)$_2$, —SO$_2$N(R)$_2$ or —NRCOOR; wherein each R independently represents H or $R_1$;

Z represents the atoms necessary to complete a 5- or 6-membered heterocyclic ring which may optionally be fused with other carbo- or heterocyclic rings;

n represents an integer of from 1–5;

X and $R_1$ may be combined to form a 5–7 membered ring; and;

$R_2$ and $R_3$ may be combined together or independently combined with A or B to form a 5–7 membered ring; and (b) a dye-receiving element comprising a support having thereon a polymeric dye image-receiving layer, the dye-receiving element being in a superposed relationship with the dye-donor element so that the dye layer is in contact with the dye image-receiving layer, the dye image-receiving layer comprising a mixture of i) a polymer having a Tg of less than about 19° C. and having no or only slight acidity; and ii) a polyester which has been polymerized in the presence of an aluminum salt and which contains an aluminum ion.

DESCRIPTION OF THE PREFERRED EMBODIMENTS

It was found that the addition of a polyester to a receiver, the polyester being polymerized in the presence of an aluminum salt and which contains an aluminum ion, substantially improves the dye protonation rate in comparison with receivers which do not contain an aluminum ion in the polyester.

The polymer having a Tg of less than about 19° C. employed in the invention may contain groups which are slightly acidic to improve water dispersibility. However, these acid groups are generally insufficient to protonate the dye.

As noted above, there are three different types of dyes which may be employed in the dye-donor element of the assemblage of the invention. The first type of dye is an electrically neutral, deprotonated, delocalized cationic dye precursor. In a preferred embodiment of the invention, these dyes have the following formula:

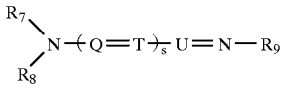

wherein:

Q, T and U form a conjugated link between nitrogen atoms selected from CH, C-alkyl, N, or a combination thereof, the conjugated link optionally forming part of an aromatic or heterocyclic ring;

$R_7$ represents H or a substituted or unsubstituted alkyl group from about 1 to about 10 carbon atoms;

$R_8$ and $R_9$ each individually represents H or a substituted or unsubstituted phenyl or a substituted or unsubstituted alkyl group from about 1 to about 10 carbon atoms; and s is 0 or an integer from 1 to 11.

Further examples of these dyes are found in U.S. Pat. Nos. 4,880,769; 5,534,478; and 5,559,076, the disclosures of which are hereby incorporated by reference. Specific examples of these dyes include the following which also have listed the absorption maxima of the deprotonated and protonated species, with the values for the latter shown in parentheses:

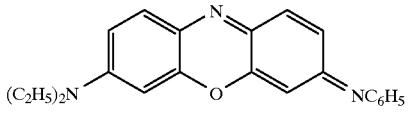

Dye 1
λ max 556 nm (641 nm)
magenta (cyan)

-continued

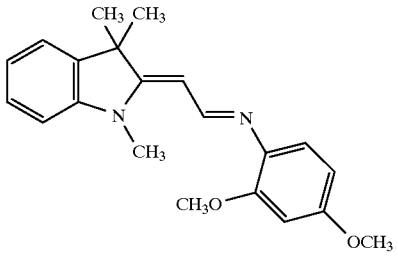

Dye 2
λ max 379 nm (405 nm)
yellow (yellow)

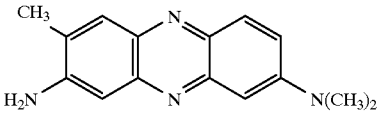

Dye 3
λ max 459 nm (536 nm)
yellow (magenta)

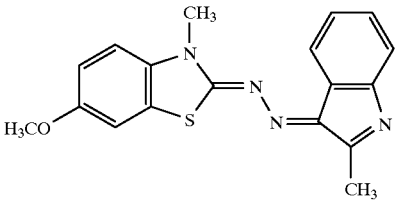

Dye 4
λ max 459 nm (522 nm)
yellow (magenta)

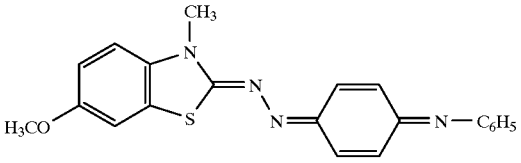

Dye 5
λ max 503 nm (621 nm)
red (blue)

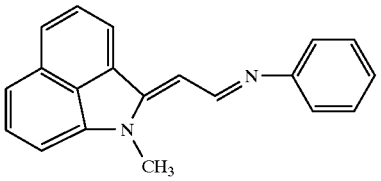

Dye 6
λ max 479 nm (513 nm)
yellow (magenta)

-continued

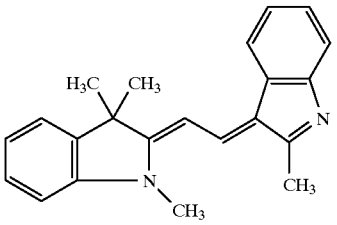

Dye 7
λ max 485 nm (495)
orange (orange)

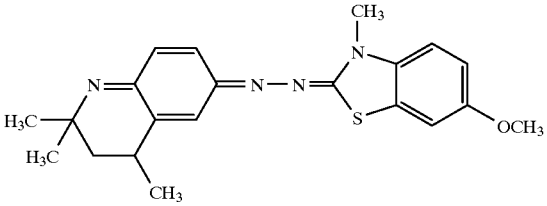

Dye 8
λ max 472 nm (601)
orange (blue)

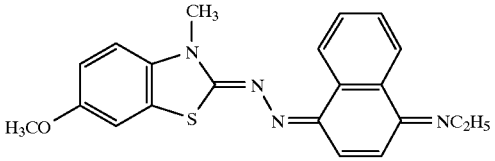

Dye 9
λ max 469 nm (618)
yellow (blue)

The second type of dye which may be employed in the dye-donor element of the assemblage of the invention has a pendant basic group as described above. Examples of these dyes are found in Japanese Patent Application J05/238174, the disclosure of which is hereby incorporated by reference. Specific examples of these dyes include the following:

Dye 10

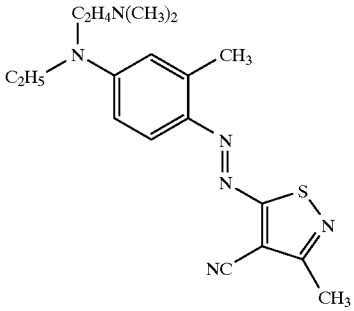

-continued

Dye 11

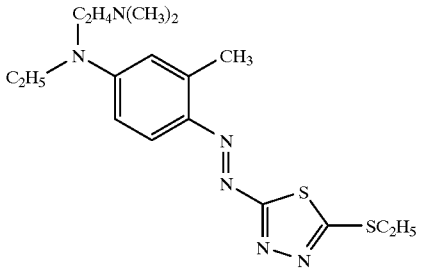

The third type of dye which may be employed in the dye-donor element of the assemblage of the invention is a cationic dye precursor as described above. In a preferred embodiment, this dye has the following formula:

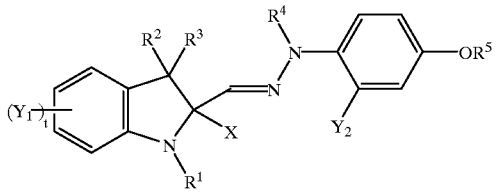

wherein:

$R^1$, $R^2$, $R^3$, $R^4$ and $R^5$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

X represents —OR, —$N(R)_2$, —NRCOR, —$NRSO_2R$, —SR, —$SO_2R$, —S(O)R, —$O_2CR$, —$NRCON(R)_2$, —$OCON(R)_2$, —$SO_2N(R)_2$ or —NRCOOR; wherein each R independently represents H or $R^1$;

$Y_1$ and $Y_2$ each independently represents R, halogen, CN, alkoxy, aryloxy, alkylthio, arylthio, alkoxycarbonyl, aryloxycarbonyl, acylamino, sulfonylamino, nitro, alkylsulfonyl, arylsulfonyl or thiocyano;

t represents an integer of from 1–4;

X and $R^1$ may be combined together with the atoms to which they are attached to form a 5–7 membered ring;

any two of $Y_1$ may be combined to form additional fused rings; and $R^2$ and $R^3$ may be combined together to form a 5–7 membered ring.

Specific examples of these dyes include the following:

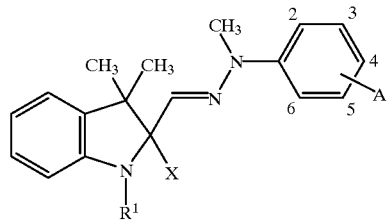

| Dye Precursor | $R^1$ | X | A | Molecular Weight | λmax (nm) (ε-max)[1] |
|---|---|---|---|---|---|
| 12 | $CH_3$ | OH | 4-$OCH_3$ | 339 | 449 (36,300) |
| 13 | —$CH_2CH_2O$— | | 4-$OC_6H_5$ | 413 | 444 (39,100) |
| 14 | —$CH_2CH_2CONH$— | | 2,4-$(OCH_3)_2$ | 408 | 426 (31,500) |
| 15 | —$CH_2CH_2CONH$— | | 4-$OCH_3$ | 378 | 455 (38,100) |
| 16 | —$CH_2CH_2O$— | | 4-$OCH_3$ | 351 | 455 (36,000) |
| 19 | —$CH_2CH(CH_2OH)O$— and —$CH_2CH(OH)CH_2O$— (mixture) | | 4-$OC_6H_5$ | 443 | 446 (38,900) |
| 17 | —$CH_2CH(CH_2OH)O$— and —$CH_2CH(OH)CH_2O$— (mixture) | | 2,4-$(OCH_3)_2$ | 411 | 422 (29,300) |
| 18 | —$CH_2CH_2O$— | | 4-$OCH_2CONHCH_3$ | 408 | 448 (38,100) |

[1]In ethanol containing HCl, ε = molar absorbtivity

Further examples of these dyes are found in copending application Ser. No. 08/996,388, filed Dec. 22, 1997, by Evans, Pyszczek and Weber, entitled Dye-Donor Element for Thermal Dye Transfer, (Docket 76728HEC).

Following are examples of low Tg polymers that may be used in the invention:

LT-1: poly(butyl acrylate-co-allyl methacrylate) 98:2 wt core/poly(glycidyl methacrylate) 10 wt shell, (Tg=−40° C.)

LT-2: poly(butyl acrylate-co-allyl methacrylate) 98:2 wt core/poly(ethyl methacrylate) 30 wt shell, (Tg=−41° C.)

LT-3: poly(butyl acrylate-co-allyl methacrylate) 98:2 wt core/poly(2-hydroxypropyl methacrylate) 10 wt shell, (Tg=−40° C.)

LT-4: poly(butyl acrylate-co-ethylene glycol dimethacrylate) 98:2 wt core/poly(glycidyl methacrylate 10 wt shell, Tg=−42° C.)

LT-5: poly(butyl acrylate-co-allyl methacrylate-co-glycidyl methacrylate) 89:2:9 wt, (Tg=−34° C.)

LT-6: poly(butyl acrylate-co-ethylene glycol dimethacrylate-co-glycidyl methacrylate) 89:2:9 wt (Tg=−28° C.)

LT-7: poly(butyl methacrylate-co-butyl acrylate-co-allyl methacrylate) 49:49:2 wt core/poly(glycidyl methacrylate) 10 wt shell, (Tg=−18° C.)

LT-8: poly(methyl methacrylate-co-butyl acrylate-co-2-hydroxyethyl methacrylate-co-2-sulfoethyl methacrylate sodium salt) 30:50:10:10 wt, (Tg=−3° C.)

LT-9: poly(methyl methacrylate-co-butyl acrylate-co-2-hydroxyethyl methacrylate-co-styrenesulfonic acid sodium salt) 40:40:10:10 wt, (Tg=0° C.)

LT-10: poly(methyl methacrylate-co-butyl acrylate-co-2-sulfoethyl methacrylate sodium salt-co-ethylene glycol dimethacrylate) 44:44:10:2 wt, (Tg=14° C.)

LT-11: poly(butyl acrylate-co-Zonyl TM®-co-2-acrylamido-2-methyl-propanesulfonic acid sodium salt) 50:45:5 wt (Tg=−39° C.)

(Zonyl TM® is a monomer from the DuPont Company)

LT-12: XU31066.50 (experimental polymer based on a styrene butadiene copolymer from Dow Chemical Company) (Tg=−31° C.)

LT-13: AC540®nonionic emulsion (Allied Signal Co.) (Tg=−55° C.)

In a preferred embodiment of the invention, the polyester polymer which is polymerized in the presence of an aluminum salt and which contains an aluminum ion is synthesized from dicarboxylates and diols and has the following formula:

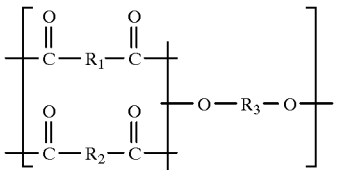

wherein $R_1$ is an aliphatic, cycloaliphatic or aromatic linkage derived from an acid, such as adipate, suberate, sebacate, cyclopentanedicarboxylate, cyclohexandicarboxylate, isophthalate or terephthalate; and comprises from 0 to 30 mole percent of the polymer;

$R_2$ is a sulphonated linkage derived from an acid, such as 5-sulphosisophthalate, 5-sulpho-1,3-cyclohexanedicarboxylate or sulfosuccinate; and comprises from 20 to 50 mole percent of the polyester; and $R_3$ is an aliphatic, fatty acid dimer, cycloaliphatic, glycolic, or polymeric linkage derived from prepolymer diols, such as ethyleneglycol, propanediol, hexanediol, decanediol; a fatty acid dimer diol such as Pripol 2203®, cyclohexanedimethanol, tricyclodecanedimethanol, diethylene glycol, hexaethylene glycol, propylene glycol, tripropylene glycol, polyethylene glycol, or polypropylene glycol; and comprises 50 mole percent of the polyester.

The aluminum salt which is added to the polyester during polymerization may be, for example, aluminum sulfate, aluminum fluoride, aluminum chloride, aluminum nitrate, aluminum phosphate, aluminum potassium sulfate, etc. The aluminum salt is generally in an anhydrous form and may be added to the polymerization in any amount that is effective for its intended purpose. In general, amounts between 1 and 5 grams of aluminum salt, per mole of monomer have been effective.

The polyester polymer which has been polymerized in the presence of an aluminum salt and which contains an aluminum ion may be present in the dye image-receiving layer in any amount which is effective for its intended purpose. In general, good results have been obtained at a polymer concentration of from about 0.5 to about 10 g/m$^2$. The polymers may be coated from organic solvents or water, if desired.

The support for the dye-receiving element employed in the invention may be transparent or reflective, and may comprise a polymeric, synthetic or cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 $\mu$m to 1000 $\mu$m. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Resistance to sticking during thermal printing may be enhanced by the addition of release agents to the dye-receiving layer or to an overcoat layer, such as silicone-based compounds, as is conventional in the art.

Any material can be used as the support for the dye-donor element employed in the invention, provided it is dimensionally stable and can withstand the heat of the thermal print heads. Such materials include polyesters such as poly (ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 $\mu$m.

Dye-donor elements that are used with the dye-receiving element of the invention conventionally comprise a support having thereon a dye layer containing the dyes as described above dispersed in a polymeric binder such as a cellulose derivative, e.g., cellulose acetate hydrogen phthalate, cellulose acetate, cellulose acetate propionate, cellulose acetate butyrate, cellulose triacetate, or any of the materials described in U.S. Pat. No. 4,700,207; or a poly(vinyl acetal) such as poly(vinyl alcohol-co-butyral). The binder may be used at a coverage of from about 0.1 to about 5 g/m$^2$.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of deprotonated dyes, as described above, capable of generating a cyan, magenta and yellow dye and the dye transfer steps are sequentially performed for each color to obtain a three-color dye transfer image. Of course, when the process is only performed for a single color, then a monochrome dye transfer image is obtained.

Thermal print heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2OO8-F3. Alternatively, other known sources of energy for thermal dye transfer may be used, such as lasers as described in, for example, GB No. 2,083,726A.

When a three-color image is to be obtained, the assemblage described above is formed on three occasions during the time when heat is applied by the thermal print head. After the first dye is transferred, the elements are peeled apart. A second dye-donor element (or another area of the donor element with a different dye area) is then brought into register with the dye-receiving element and the process repeated. The third color is obtained in the same manner. After thermal dye transfer, the dye image-receiving layer contains a thermally-transferred dye image.

The following examples are provided to further illustrate the invention.

EXAMPLES

EXAMPLE 1

Synthesis of Sulfonated monomers

Synthesis of dimethylsulfosuccinic acid, sodium salt.

A 70% solution in water of sulfosuccinic acid from Aldrich was used; 250 g, 0.88 moles of the acid was taken up in 1 L of methanol. The mixture was heated overnight at 65° C. After cooling to room temperature 35.2 g, 0.88 moles of sodium hydroxide dissolved in 70 ml of water was added dropwise over two hours. During the addition, a white precipitate formed which was filtered upon completion of the addition and 90 grams of the solid was collected. Proton NMR in deuterium oxide and mass spectroscopy confirms the structure of this material. A second crop of the material was obtained (79 grams) by removing the solvents in the filtrate and recrystallizing the resulting solid with hot isopropanol.

The synthesis of dimethyl-5-sulpho-1,3-cyclohexanedicarboxylate, sodium salt, was carried out in an analogous manner, from 5-sulpho-1,3-cyclohexanedicarboxylate, monosodium salt.

EXAMPLE 2

Synthesis of Polyesters in the presence of aluminum salts

Synthesis of P-1

0.25 moles sodium dimethyl-5-sulfoisophthalate, 0.25 moles dimethylcyclohexanedicarboxylate, 0.25 moles cyclohexanedimethanol, 0.25 moles decanediol and 3.2 g anhydrous aluminum sulfate were weighed into a 250 mL round-bottom, long-necked flask. A take-off arm was attached to the top of the flask. Under a nitrogen stream, the monomers were first melted at 250° C., then the molten monomers were purged with nitrogen. Antimony pentoxide, 0.5 mL of a 6% dispersion in ethylene glycol was added. Five drops of neat titanium isopropoxide were added, and the resulting methanol distillate was collected. After two hours, a vacuum manifold and a stir paddle was attached to the flask, and a vacuum applied with stirring. The reaction continued for two hours under vacuum. The flask was then allowed to cool to room temperature for 30 minutes, before the vacuum was released. Polymers were isolated by freezing the flasks in liquid nitrogen and breaking the flask. The resultant polymer had a Tg of 125° C.

The amount of aluminum in the resulting polymer was measured by inductively coupled plasma atomic emission spectroscopy (ICP-AES) after digesting in a mixture of sulfuric and nitric acids and reported as mg/g of A1 in Table 1.

Synthesis of Polymers P-2 and P-3 were carried out in the same way as the synthesis of P-1 except that monomers and the aluminum sulfate amounts indicated in Table 1 were used.

Synthesis of Polymers P-3 and P-6 were carried out in the same way as the synthesis of P-1 except that monomers and the aluminum sulfate amounts indicated in Table 1 were used, and the first two hours of the reaction were carried out at 200° C.

TABLE 1

| Polymer | Composition | Anhydrous $Al_2(SO_4)_3$ (g) | Tg (° C.) | Al in Polymer (mg/g) |
|---|---|---|---|---|
| P-1 | sodium dimethyl-5-sulfoisophthalate; dimethylcyclohexane-dicarboxylate; cyclohexanedimethanol; decanediol | 3.2 | 125 | 0.96 |
| P-2 | sodium dimethyl sulfosuccinate; dimethylcyclohexane-dicarboxylate; cyclohexanedimethanol; decanediol | 2.9 | 87 | 0.91 |
| P-3 | sodium dimethyl-5-sulpho-1,3-cyclohexane dicarboxylate; dimethylcyclohexane-dicarboxylate; cyclohexanedimethanol; decanediol | 3.2 | 110 | 1.0 |
| P-4 | sodium dimethyl sulfosuccinate; Dimethylisophthalate; | 1.1 | 0 | 0.41 |

TABLE 1-continued

| Polymer | Composition | Anhydrous $Al_2(SO_4)_3$ (g) | Tg (° C.) | Al in Polymer (mg/g) |
|---|---|---|---|---|
| | diethyleneglycol; Decanediol; | | | |
| P-5 | sodium dimethyl sulfosuccinate; Dimethylisophthalate; diethyleneglycol; Decanediol; | 2.2 | 9 | 0.87 |
| P-6 | sodium dimethyl sulfosuccinate; Dimethylisophthalate; diethyleneglycol; Decanediol; | 4.4 | 49 | 2.0 |

EXAMPLE 3

Synthesis of a low Tg polymer, LT-1, Poly(butyl acrylate-co-allyl methacrylate) 98:2 wt core/poly (glycidylmethacrylate) 10 wt shell To a 12 L 3-neck flask fitted with a stirrer and condenser were added 2400 mL degassed distilled water, 26.8 mL 45% Dowfax® 2A1 surfactant (Dow chemical) and 8 g sodium carbonate. The flask was heated to 80° C. Subsequently, 4,4'-azobis(4-cyanovaleric acid) (16 g 75% aqueous solution) was added followed by the contents from an addition flask containing 2400 mL degassed distilled water, 26.8 mL 45% Dowfax® 2A1 surfactant, 1176 g butyl acrylate and 24 g allyl methacrylate over a period of two hours. The pH of the resulting polymer was adjusted to 7 with 10% acetic acid solution, and it was stirred at 80° C. for one hour. Subsequently, 4,4'-azobis(4-cyanovaleric acid) (0.6 g 75% aqueous solution) was added followed by the contents from an addition flask containing 480 mL degassed distilled water, 18 mL 45% Dowfax® 2A1 surfactant, 120 g allyl methacrylate over a period of 90 min. The resulting polymer was stirred at 80° C. for 2 hours and then cooled to 25° C. The pH was adjusted to 7 with sodium carbonate. The low Tg polymer contained 19.9% solids and had a particle size of 92.8 nm and a Tg of −40° C.

EXAMPLE 4

Formulation of Coating Melts For Dye Image Receiver

Control Receiver Element C-1:

Each coating melt of the invention contained a polymer of the invention and the low Tg polymer LT-1, in the amounts shown in Table 2. The mg/g of A1 present in each polymer of the invention were measured and the polymers were coated at levels to give the same amount of A1 present in each coating. As comparisons, two polyesters that were not polymerized in the presence of aluminum are used, and aluminum sulfate x 18 $H_2O$ was added to the polyester dispersion.

Control polymer CP-1 is poly[isophthalic acid-co-5-sulfoisophthalic acid (90:10 molar ratio)-diethylene glycol (100 molar ratio), (sulfonic acid of AQ29, Eastman Chemical Company) and polymer CP-2 is poly[1,4-cyclohexane dicarboxylic acid-co co-5-sulfoisophthalic acid (92:8 molar ratio)-1,4-cyclohexanedimethanol (100 molar ratio) which is disclosed for use in thermal dye transfer elements in U.S. Pat. No. 5,317,001.

TABLE 2

| Polymer | Polymer (g/m$^2$) | LT-1 (g/m$^2$) | Melt Stability |
|---|---|---|---|
| P-1 | 1.39 | 5.34 | stable |
| P-2 | 1.46 | 5.26 | stable |
| P-3 | 1.33 | 5.39 | stable |
| P-4 | 3.25 | 3.48 | stable |
| P-5 | 1.53 | 5.20 | stable |
| P-6 | 0.67 | 6.06 | stable |
| CP-1 | 2.10[1] | 4.04 | coagulated |
| CP-2 | 2.10[1] | 4.04 | coagulated |

[1]Coatings also contained 0.59 g/m$^2$ of $Al_2(SO_4)_3 \times 18H_2O$

The above results show that melts containing polyesters that have been polymerized in the presence of an aluminum salt and which contains an aluminum ion (P-1 through P-6) are more stable than those containing a mixture of a polyester that was not polymerized in the presence of an aluminum salt but which contained an aluminum salt that was added before coating (CP-1 and CP-2).

EXAMPLE 5

Preparation of Receiver Elements

Control Receiver Element C-1:

The element was prepared by first extrusion-laminating a paper core with a 38 micron thick microvoided composite film (OPPalyte® 350TW, Mobil Chemical Co.) as disclosed in U.S. Pat. No. 5,244,861. The composite film side of the resulting laminate was then coated with the following layers in the order recited:

1) a subbing layer of Prosil® 221 (0.05 g/m$^2$) and Prosil® 2210 (0.05 g/m$^2$) (PCR, Inc.) coated from 3A alcohol;
2) and the dye image-receiving layer was a mixture of 2.69 g/m$^2$ of the polyester CP-1, (sulfonic acid of AQ29, Eastman Chemical Company), 4.04 g/m$^2$ of LT-1 and 0.022 g/m$^2$ of a fluorocarbon surfactant (Fluorad® FC-170, 3M Corporation), coated from distilled water. This composition was analogous to Receiver Elements 7 through 18 in Example 1 of U.S. Pat. No. 5,627,128.

Receiver Elements 1 through 6 of the Invention:

Receiver Elements 1–6 were prepared as described above for Control Receiver Element C-1, except the subbing layer was 0.02 g/m$^2$ Polymin P® polyethyleneimine (BASF) coated from distilled water and the dye receiving layer was composed of the mixtures listed in Table 2 above using 0.022 g/m$^2$ of a fluorocarbon surfactant (Fluorad® FC-170, 3M Corporation), coated from distilled water.

EXAMPLE 6

Dye-Donor Elements

Individual dye-donor elements were prepared by coating the following compositions in the order listed on a 6 $\mu$m poly(ethylene terephthalate) support:

1) a subbing layer of Tyzor TBT®, a titanium tetrabutoxide, (DuPont Company) (0.16 g/m$^2$) coated from 1-butanol; and
2) an imaging dye layer coated from a tetrahydrofuran/cylopentanone (95/5) solvent mixture, whereby two different binder polymer mixtures were used with the selected dye as shown in Table 3 below:
   DB-1 propionate ester of bisphenol A copolymer with epichlorohydrin (prepared by techniques similar to those described in U.S. Pat. No. 5,244,862);

DB-2 poly(butyl methacrylate-co-Zonyl TM®) (75/25) where Zonyl TM® is a perfluoro monomer available from DuPont.

Details of dye and binder laydowns are summarized in the following Table 3.

TABLE 3

| Dye Donor Element | Deprotonated Dye | Dye Laydown ($g/m^2$) | DB-1 Laydown ($g/m^2$) | DB-2 Laydown ($g/m^2$) |
|---|---|---|---|---|
| 1 | Dye 2 | 0.28 | 0.29 | 0.05 |
| 2 | Dye 1 | 0.15 | 0.19 | 0.03 |

On the back side of the dye-donor element were coated the following compositions in the order listed:

1) a subbing layer of Tyzor TBT®, a titanium tetrabutoxide, (DuPont Company) (0.16 $g/m^2$) coated from 1-butanol; and 2) a slipping layer of 0.38 $g/m^2$ poly(vinyl acetal) (Sekisui), 0.022 $g/m^2$ Candelilla wax dispersion (7% in methanol), 0.011 $g/m^2$ PS513 amino-terminated polydimethylsiloxane (Huls) and 0.0003 $g/m^2$ p-toluenesulfonic acid coated from a 3-pentanone/distilled water (98/2) solvent mixture.

EXAMPLE 7

Evaluation of Thermal Dye Transfer Images

Eleven-step sensitometric cyan thermal dye transfer images were prepared from the above Dye Donor Element 2 and dye-receiver elements. The dye side of the dye-donor element approximately 10 cm×15 cm in area was placed in contact with a receiving-layer side of a dye-receiving element of the same area. This assemblage was clamped to a stepper motor-driven, 60 mm diameter rubber roller. A thermal head (TDK No. 8I10625 with a resolution of 5.4 dots/mm, thermostatted at 25° C.) was pressed with a force of 24.4 Newton (2.5 kg) against the dye donor element side of the assemblage, pushing it against the rubber roller.

The imaging electronics were activated causing the donor-receiver assemblage to be drawn through the print head/roller nip at 40.3 mm/sec. Coincidentally, the resistive elements in the thermal print head were pulsed for 127.75 μs/pulse at 130.75 μs intervals during a 4.575 msec/dot printing cycle (including a 0.391 msec/dot cool-down interval). A stepped image density was generated by incrementally increasing the number of pulses/dot from a minimum of 0 to a maximum of 32 pulses/dot. The voltage supplied to the thermal head was approximately 12.5 v resulting in an instantaneous peak power of 0.294 watts/dot and a maximum total energy of 1.20 mJ/dot. This procedure was done using a cyan donor to produce a cyan stepped image. Print room humidity: 40% RH.

For images containing a cyan dye, protonation causes a color change from the deprotonated dye form (magenta) to the protonated dye form (cyan). This color change can be monitored by measuring status A red (cyan) and green (magenta) densities at various time intervals and calculating the red/green ratio as a function of time.

After printing, the dye-donor element was separated from the imaged receiving element and the Status A reflection red and green densities at step 10 in the stepped-image were measured for the cyan image using an X-Rite 820® Reflection Densitometer (X-Rite Corp.) after 1.0 minute at room temperature. The prints were then placed in a 50° C./50% RH oven for 3.0 hours (incubation) and the red and green densities were reread. A red/green (R/G) ratio (minus the baseline) was calculated for the cyan image in each receiver after 1.0 minute and after 3.0 hours of incubation and the % dye conversion for the cyan dye was calculated assuming the incubated R/G ratios represented 100% dye conversion. Complete dye conversion (dye reprotonation) of the cyan dye in the cyan image occurs when the red/green ratio after incubation is greater than 2.0. The results are summarized in Table 4 below.

TABLE 4

| Receiver Element | Polymer | R/G Ratio, 1 minute | R/G Ratio, incubated | % Dye Conversion, 1 minute |
|---|---|---|---|---|
| 1 | P-1 | 3.48 | 5.19 | 67 |
| 2 | P-2 | 2.98 | 4.78 | 62 |
| 3 | P-3 | 2.80 | 4.58 | 61 |
| 4 | P-4 | 3.52 | 5.19 | 68 |
| 5 | P-5 | 3.68 | 5.09 | 72 |
| 6 | P-6 | 2.64 | 4.26 | 62 |
| C-1 | CP-1 | 3.10 | 5.92 | 52 |

The above results show that using polyesters that were polymerized in the presence of an aluminum salt and which contains an aluminum ion as the acid source in the receiver element (1 through 6) gave improved dye conversion (protonation) relative to prior art receiver elements containing sulfonic acid derived polyesters as the acid source (C-1).

EXAMPLE 8

Donor and Receiver Elements

Control Receiver Element C-2:

This receiving element was prepared as described above for Receiver Elements 1 through 6 in Example 5 except the dye-receiving layer was 7.23 $g/m^2$ of Vylon 200® (Toyobo Co., Ltd.), a polyester similar to Vylon 280®, described in JP05-238174, Example 1, 0.72 $g/m^2$ of trichlorophenol (acidic substance I-12 of JP05-238174, pKa=6.0) and 0.66 $g/m^2$ polyisocyanate (Desmodour N3300®, Mobay Corp.) coated from toluene, cyclohexanone (46/46/8). This receiving element is essentially the same as described in Example 1 of JP05-238174.

Dye Donor Element 3:

This was the same as the dye donor elements described in Example 6 above except the dye layer was 0.20 $g/m^2$ of Dye 11, a mixture of cellulose acetate propionate 482-.5 and 482-20 (0.11 $gm^2$ each) (Eastman Chemical Company), 0.06 $g/m^2$ of poly(butyl methacrylate-co-Zonyl TM®) 75:25, where Zonyl TM is a fluorinated acrylate monomer (DuPont Chemical Co.), 0.02 $g/m^2$ of Paraplex G25® (a polyester sebacate, C.P. Hall Company) and 0.01 $g/m^2$ of 2,4,6-trimethylanilide of phenyl-indan-diacid (TMA) coated from a mixture of toluene/methanol/cyclohexanone (70/25/5).

Dye-Donor Element 4:

This was the same as Dye Donor Element 3 except the subbing layer contained 0.04 $g/m^2$ Polymin P® polyethyleneimine (BASF Corp.) and 0.01 $g/m^2$ of poly(butyl acrylate-co-allyl methacrylate) (98:2) 70 wt. core/poly (glycidyl methacrylate) 30 wt. shell, coated from water; and the dye layer contained 0.33 $g/m^2$ of Dye 13, 0.49 $g/m^2$ poly(vinyl butyral) (Butvar B76®, Monsanto Company), 0.16 $g/m^2$ of poly(butyl methacrylate-co-Zonyl TM®) 75:25 and 0.005 $g/m^2$ FC-431® fluorocarbon surfactant (3M Company) coated from a toluene/n-propanol/cyclohexanone (65/30/5) solution.

EXAMPLE 9

Evaluation of Thermal Dye Transfer Images Generated in Example 8

Evaluation was the same as described in Example 7 above except the print voltage was 13.0 volts resulting in an instantaneous peak power of 0.318 watts/dot and a maximum total energy of 1.30 mJ/dot. This procedure used yellow dye-donor element 4 and magenta dye-donor element 3 to produce yellow and magenta stepped images. Print room humidity: 30% RH.

After printing, the imaged receiving element was separated from the donor element and placed into an oven at 50° C./50% RH for 3 hours to ensure that the dye was evenly distributed throughout the receiving layer. After incubation, the appropriate Status A reflection densities (green or blue) of each of the eleven steps were measured using an X-Rite 820® reflection densitometer and the density values measured at step 11 (D-max, a measure of the efficiency of dye transfer) for each combination are listed in Tables 5 and 6. The effectiveness of binding pendant basic dyes like Dye 3 or cationic dye precursors (Dye 4) to the receiving elements of said invention was determined by placing the imaged side of the stepped image in intimate contact with a similarly sized piece of a plasticized poly(vinyl chloride), (PVC) report cover, a 1 Kg weight was placed on top and the whole assemblage was incubated in an oven at 50° C. for 1 week. The PVC sheet was separated from the stepped image and the Status A green transmission density in the PVC (a measure of the amount of unwanted dye migration into the PVC) corresponding to the maximum density step of the original stepped image was measured with an X-Rite 820® reflection densitometer. The retransfer densities for each dye-donor:dye receiver combination are listed in Tables 5 and 6. Low numbers indicate effective binding of the dye to the receiving elements.

The retransfer densities for Dye 4 (Table 6) are unreliable because the unprotonated (unbound) dye is nearly colorless. For this dye, the degree of protonation was determined by suspending the imaged receiver elements in a closed vessel containing concentrated hydrochloric acid (HCl) for 1.0 minutes. The Status A blue densities of the stepped images were reread as above and the % increase in density at D-max is listed in Table 6. Higher numbers reflect less protonated dye in the original (unfumed) receiving element whereas a low % increase indicated more effective protonation/binding of the transferred dye in the receiving element.

TABLE 5

Data for Dye-Donor Element 3

| Receiver Element | Maximum Reflection Density (Status A Green) | Retransfer Density (Status A Green) |
|---|---|---|
| 1 | 2.47 | 0.04 |
| 2 | 2.52 | 0.04 |
| 3 | 2.46 | 0.03 |
| 4 | 2.50 | 0.05 |
| 5 | 2.61 | 0.06 |
| 6 | 2.66 | 0.04 |
| C-2 | 1.40 | 0.30 |

TABLE 6

Data for Dye-Donor Element 4

| Receiver Element | Maximum Reflection Density (Status A) | Retransfer Density (Status A Blue) | % Change in Density after Fuming with HCL (Status A Blue) |
|---|---|---|---|
| 1 | 2.07 | 0.03 | 1 |
| 2 | 1.90 | 0.04 | 0 |
| 3 | 1.99 | 0.04 | 4 |
| 4 | 1.90 | 0.09 | 2 |

TABLE 6-continued

Data for Dye-Donor Element 4

| Receiver Element | Maximum Reflection Density (Status A) | Retransfer Density (Status A Blue) | % Change in Density after Fuming with HCL (Status A Blue) |
|---|---|---|---|
| 5 | 1.93 | 0.06 | 2 |
| 6 | 1.66 | 0.09 | 0 |
| C-2 | 0.30 | 0.01 | 300 |

The above data show that the polyesters that were polymerized in the presence of an aluminum salt and which contain an aluminum ion as the acid source in the receiver element (1 through 6) were effective at binding (low retransfer numbers) the pendant basic dye (Dye 11, Dye-Donor Element 3), whereas the control receiver element described in J05-238174 (C-2) was not as effective (high retransfer numbers).

For the cationic dye precursor (Dye 13, Dye-Donor Element 4), the retransfer density values summarized in Table 6 are unreliable because the unprotonated (unbound) dye is nearly colorless. Based on the % change data shown in Table 6, polyesters that were polymerized in the presence of an aluminum salt and which contain an aluminum ion as the acid source in the receiver element (1 through 6) were effective at protonating the cationic dye precursor (Dye 13, low % change values) whereas the control receiver element described in J05-238174 (C-2) was not (high % change values).

The invention has been described in detail with particular reference to preferred embodiments thereof, but it will be understood that variations and modifications can be effected within the spirit and scope of the invention.

What is claimed is:

1. A thermal dye transfer assemblage comprising:

(a) a dye-donor element comprising a support having thereon a dye layer comprising a dye dispersed in a polymeric binder, said dye being:

I) an electrically neutral, deprotonated, delocalized cationic dye precursor;

II) a pendant basic dye of the formula D-(L-E)$_m$ wherein D represents the residue of a dye, L represents a linking group, E represents a moiety with basic properties and m is an integer of 1–3; or III) a cationic dye precursor having the following structure:

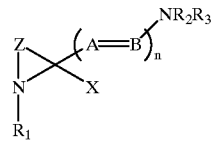

wherein:

$R_1$, $R_2$ and $R_3$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

A and B each independently represents N or CR and may be part of an aromatic or heteroaromatic ring system;

X represents —OR, —N(R)$_2$, —NRCOR, —NRSO$_2$R, —SR, —SO$_2$R, —S(O)R, —O$_2$CR, —NRCON(R)$_2$, —OCON(R)$_2$, —SO$_2$N(R)$_2$ or —NRCOOR; wherein each R independently represents H or R$_1$;

Z represents the atoms necessary to complete a 5- or 6-membered heterocyclic ring which may optionally be fused with other carbo- or heterocyclic rings;

n represents an integer of from 1–5;

X and R$_1$ may be combined to form a 5–7 membered ring; and;

R$_2$ and R$_3$ may be combined together or independently combined with A or B to form a 5–7 membered ring; and (b) a dye-receiving element comprising a support having thereon a polymeric dye image-receiving layer, the dye-receiving element being in a superposed relationship with the dye-donor element so that the dye layer is in contact with the dye image-receiving layer, the dye image-receiving layer comprising a mixture of i) a polymer having a Tg of less than about 19° C. and having no or only slight acidity; and ii) a polyester which has been polymerized in the presence of an aluminum salt and which contains an aluminum ion.

2. The assemblage of claim 1 wherein said polymer having a Tg of less than about 19° C. is an acrylic polymer, a styrene polymer or a vinyl polymer.

3. The assemblage of claim 1 wherein said deprotonated, delocalized cationic dye precursor has the following formula:

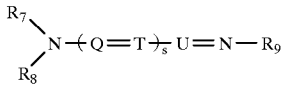

wherein:

Q, T and U form a conjugated link between nitrogen atoms selected from CH, C-alkyl, N, or a combination thereof, the conjugated link optionally forming part of an aromatic or heterocyclic ring;

R$_7$ represents H or a substituted or unsubstituted alkyl group from about 1 to about 10 carbon atoms;

R$_8$ and R$_9$ each individually represents H or a substituted or unsubstituted phenyl or a substituted or unsubstituted alkyl group from about 1 to about 10 carbon atoms; and s is 0 to 11.

4. The assemblage of claim 1 wherein said cationic dye precursor has the following formula:

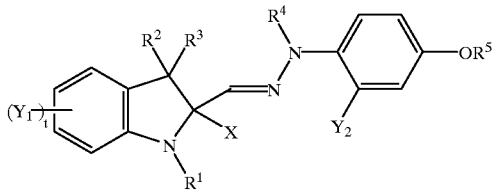

wherein:

R$^1$, R$^2$, R$^3$, R$^4$ and R$^5$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

X represents —OR, —N(R)$_2$, —NRCOR, —NRSO$_2$R, —SR, —SO$_2$R, —S(O)R, —O$_2$CR, —NRCON(R)$_2$, —OCON(R)$_2$, —SO$_2$N(R)$_2$ or —NRCOOR; wherein each R independently represents H or R$^1$;

Y$_1$ and Y$_2$ each independently represents R, halogen, CN, alkoxy, aryloxy, alkylthio, arylthio, alkoxycarbonyl, aryloxycarbonyl, acylamino, sulfonylamino, nitro, alkylsulfonyl, arylsulfonyl or thiocyano;

t represents an integer of from 1–4;

X and R$^1$ may be combined together with the atoms to which they are attached to form a 5–7 membered ring;

any two of Y$_1$ may be combined to form additional fused rings; and

R$^2$ and R$^3$ may be combined together to form a 5–7 membered ring.

5. The assemblage of claim 1 wherein said polyester has the formula:

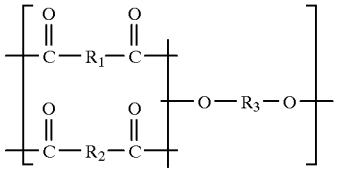

wherein

R$_1$ is an aliphatic, cycloaliphatic or aromatic linkage derived from an acid and comprises from 0 to 30 mole percent of the polymer;

R$_2$ is a sulphonated linkage derived from an acid and comprises from 20 to 50 mole percent of the polyester; and R$_3$ is an aliphatic, fatty acid dimer, cycloaliphatic, glycolic, or polymeric linkage derived from prepolymer diols; and comprises 50 mole percent of the polyester.

6. The assemblage of claim 5 wherein said polyester is present in said dye image-receiving layer in an amount of from about 0.02 to about 5.0 g/m$^2$.

7. The assemblage of claim 1 wherein said aluminum salt is anhydrous aluminum sulfate.

8. A process of forming a dye transfer image comprising imagewise-heating a dye-donor element comprising a support having thereon a dye layer comprising a dye dispersed in a polymeric binder, and imagewise transferring said dye to a dye-receiving element to form said dye transfer image, said dye-receiving element comprising a support having thereon a polymeric dye image-receiving layer, said dye-donor element comprising a support having thereon a dye layer comprising a dye dispersed in a polymeric binder, said dye being:

I) an electrically neutral, deprotonated, delocalized cationic dye precursor;

II) a pendant basic dye of the formula D-(L-E)$_m$ wherein D represents the residue of a dye, L represents a linking group, E represents a moiety with basic properties and m is an integer of 1–3; or III) a cationic dye precursor having the following structure:

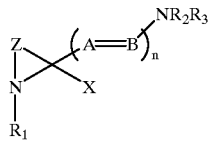

wherein:

$R_1$, $R_2$ and $R_3$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

A and B each independently represents N or CR and may be part of an aromatic or heteroaromatic ring system;

X represents —OR, —$N(R)_2$, —NRCOR, —$NRSO_2R$, —SR, —$SO_2R$, —S(O)R, —$O_2CR$, —$NRCON(R)_2$, —$OCON(R)_2$, —$SO_2N(R)_2$ or —NRCOOR; wherein each R independently represents H or $R_1$;

Z represents the atoms necessary to complete a 5- or 6-membered heterocyclic ring which may optionally be fused with other carbo- or heterocyclic rings;

n represents an integer of from 1–5;

X and $R_1$ may be combined to form a 5–7 membered ring; and;

$R_2$ and $R_3$ may be combined together or independently combined with A or B to form a 5–7 membered ring; and (b) a dye-receiving element comprising a support having thereon a polymeric dye image-receiving layer, the dye-receiving element being in a superposed relationship with the dye-donor element so that the dye layer is in contact with the dye image-receiving layer, the dye image-receiving layer comprising a mixture of i) a polymer having a Tg of less than about 19° C. and having no or only slight acidity; and ii) a polyester which has been polymerized in the presence of an aluminum salt and which contains an aluminum ion.

9. The process of claim 8 wherein said polymer having a Tg of less than about 19° C. is an acrylic polymer, a styrene polymer or a vinyl polymer.

10. The process of claim 8 wherein said deprotonated, delocalized cationic dye precursor has the following formula:

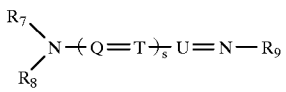

wherein:

Q, T and U form a conjugated link between nitrogen atoms selected from CH, C-alkyl, N, or a combination thereof, the conjugated link optionally forming part of an aromatic or heterocyclic ring;

$R_7$ represents H or a substituted or unsubstituted alkyl group from about 1 to about 10 carbon atoms;

$R_8$ and $R_9$ each individually represents H or a substituted or unsubstituted phenyl or a substituted or unsubstituted alkyl group from about 1 to about 10 carbon atoms; and s is 0 to 11.

11. The process of claim 8 wherein said cationic dye precursor has the following formula:

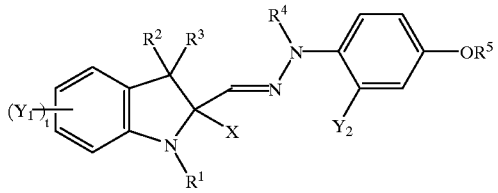

wherein:

$R^1$, $R^2$, $R^3$, $R^4$ and $R^5$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

X represents —OR, —$N(R)_2$, —NRCOR, —$NRSO_2R$, —SR, —$SO_2R$, —S(O)R, —$O_2CR$, —$NRCON(R)_2$, —$OCON(R)_2$, —$SO_2N(R)_2$ or —NRCOOR; wherein each R independently represents H or $R^1$;

$Y_1$ and $Y_2$ each independently represents R, halogen, CN, alkoxy, aryloxy, alkylthio, arylthio, alkoxycarbonyl, aryloxycarbonyl, acylamino, sulfonylamino, nitro, alkylsulfonyl, arylsulfonyl or thiocyano;

t represents an integer of from 1–4;

X and $R^1$ may be combined together with the atoms to which they are attached to form a 5–7 membered ring;

any two of $Y_1$ may be combined to form additional fused rings; and $R^2$ and $R^3$ may be combined together to form a 5–7 membered ring.

12. The process of claim 8 wherein said polyester has the formula:

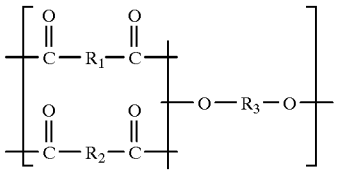

wherein $R_1$ is an aliphatic, cycloaliphatic or aromatic linkage derived from an acid and comprises from 0 to 30 mole percent of the polymer;

$R_2$ is a sulphonated linkage derived from an acid and comprises from 20 to 50 mole percent of the polyester; and $R_3$ is an aliphatic, fatty acid dimer, cycloaliphatic, glycolic, or polymeric linkage derived from prepolymer diols; and comprises 50 mole percent of the polyester.

13. The process of claim 8 wherein said polyester is present in said dye image-receiving layer in an amount of from about 0.02 to about 5.0 g/$m^2$.

14. The process of claim 8 wherein said aluminum salt is anhydrous aluminum sulfate.

* * * * *